US007182836B2

(12) United States Patent
Patt et al.

(10) Patent No.: US 7,182,836 B2
(45) Date of Patent: Feb. 27, 2007

(54) METHOD FOR DELIGNIFYING LIGNOCELLULOSIC RAW MATERIALS

(75) Inventors: Rudolf Patt, Reinbek (DE); Othar Kordsachia, Oststeinbek (DE); Bjorn Rose, Hamburg (DE)

(73) Assignee: Voith Paper Fiber Systems GmbH KG, Ravenburg (DE)

( * ) Notice: Subject to any disclaimer, the term of this patent is extended or adjusted under 35 U.S.C. 154(b) by 0 days.

(21) Appl. No.: 10/482,617

(22) PCT Filed: Jul. 1, 2002

(86) PCT No.: PCT/EP02/07238

§ 371 (c)(1),
(2), (4) Date: Dec. 29, 2003

(87) PCT Pub. No.: WO03/002813

PCT Pub. Date: Jan. 9, 2003

(65) Prior Publication Data

US 2004/0177937 A1 Sep. 16, 2004

(30) Foreign Application Priority Data

Jun. 29, 2001 (DE) ..... 101 31 028

(51) Int. Cl.
*D21C 3/02* (2006.01)
*D21C 3/04* (2006.01)
*D21C 3/20* (2006.01)

(52) U.S. Cl. ..... 162/90; 162/24; 162/25; 162/77; 162/83

(58) Field of Classification Search ..... 162/72, 162/82, 83, 90, 19, 70, 77, 17, 24–26
See application file for complete search history.

(56) References Cited

U.S. PATENT DOCUMENTS 3,630,832 A * 12/1971 Ingruber et al. ..... 162/49
4,213,821 A * 7/1980 Vanderhoek et al. ..... 162/72
4,384,921 A * 5/1983 Pihlajamaki et al. ..... 162/72
4,473,439 A * 9/1984 Wada et al. ..... 162/72
4,767,500 A * 8/1988 Patt et al. ..... 162/32

(Continued)

FOREIGN PATENT DOCUMENTS

CA 2318027 9/2000

(Continued)

OTHER PUBLICATIONS

Grier, Von. J., On the Chemistry of Neutral Sulphite Cooking, German language, Jan. 22, 1968, pp. 649-654, Germany.

(Continued)

*Primary Examiner*—Eric Hug
(74) *Attorney, Agent, or Firm*—Bachman & LaPointe, P.C.

(57) ABSTRACT

The invention relates to a method for delignifying lignocellulosic raw materials by using sulfites in the presence of an alkaline component, especially sodium hydroxide or sodium carbonate or a mixture thereof in an aqueous solution at a high temperature and high pressure. The invention is characterized in that a first partial fragment of the alkaline component is added when the aqueous solution starts to decompose and in that at least a second partial fragment of the alkaline component is added only when delignification begins.

47 Claims, 4 Drawing Sheets

Profile of pH value of alkaline pulping solution during heating phase of ASA spruce cooking as a function of NaOH use

U.S. PATENT DOCUMENTS 4,786,365 A * 11/1988 Teder et al. ..... 162/65

FOREIGN PATENT DOCUMENTS

| | | | |
|---|---|---|---|
| EP | 0 892 107 | * | 7/1998 |
| ZA | 77/3044 | | 5/1977 |

OTHER PUBLICATIONS

Gellerstedt, Goran, The reactions of lignin during sulfite pulping, 1976, pp. 537-543, Swedish Forest Products Research Laboratory, Chemistry Department, Stockholm Sweden.

Gierer, Josef, Lindeberg, Otto, Noren, Isa, Alkaline Delignification in the Presence of Anthraquinone/ Anthrahydroquinone, 1979, pp. 213-214, Swedish Forest Products Research Laboratory, Chemistry Department, Stockholm Sweden.

Ojanen, Eeva, Tulppala, Jorma, Virkola, Nils-Erik, Neutral sulphite anthraquinone (NS-AQ) cooking of pine and birch wood chips, 1982, pp. 453-464, Finland.

Virkola, Nils-Erik, Pusa, Raimo, Kettunen, Jukka, Neutral sulfite AQ pulping as an alternative to kraft pulping, 1981, pp. 103-108, Finland.

Tikka, Pirkko, Tulppala, Jorma, Virkola, Nils-Erik, Neutral Sulphite AQ pulping and bleaching of the pulps, 1982, pp. 11-21, Finland.

Raubenheimer, S., Eggers, S.H., On pulp cooking with Sulphite and Anthraquinone,German language, 1980, pp. 19-23, Germany.

Stradal, Ingruber, M., Histed, J.A., Alkaline sulphite-anthraquinone pulping of eastern Canadian woods, Pulp & Paper Canada 83:12 (1982), pp. 79-88, Canada.

Ingruber, Otto V., Alkaline Sulfite Anthraquinone Pulping, 1985 Pulping Conference, pp. 451-461, Canada.

Cameron, D.W., Jessup, B., Nelson, P.F., Raverty, W.D., Samuel, E., Vanderhoek, N., The Response of Pines and Eucalypts to NSSC-AQ Pulping, pp. 64-71, Australia.

Suckling, Ian D., The Role of Anthraquinone in Sulphite-Anthraquinone Pulping, 1989, pp. 503-510, New Zealand.

"A Comparison of Bleachability in TCF Sequences for Alkaline Sulphite and Kraft Pulps", Journal of Pulp and Paper Science, By A. Teder and K. Sjostrom.

A. Teder and K. Sjostrom., A Comparison of Bleachability in TCF Sequences for Alkaline Sulphite and Kraft Pulps, Journal of Pulp and Paper Science, vol. 22 No. 8, Aug. 1996.

* cited by examiner

AS-AQ Pulp Using 27.5 % chemicals

Profile of pH value of alkaline pulping solution during heating phase of ASA spruce cooking as a function of NaOH use Determination of residual alkali for the ASA pulping of spruce with alkali-

METHOD FOR DELIGNIFYING LIGNOCELLULOSIC RAW MATERIALS

The invention relates to a method for delignifying lignocellulosic raw materials. Such a method is technically also known as pulping.

Lignocellulose containing raw materials, such as wood or grasses are used for the manufacture of cellulose. In order to minimize both energy consumption in cellulose manufacture and the pollution of the environment, it is desirable to remove as much lignin as possible in the first process step, i.e. pulping, without degrading the cellulose too much. Only when delignification can be continued until only a small residue of lignin remains, it is possible, using reasonable amounts of chemicals, to bleach to high grades of whiteness.

Known methods for delignifying lignocellulosic raw materials using sulfites as an effective lignin reducing component (sulfite pulping) are carried out in an acidic, neutral and alkaline pH ranges. The methods in neutral and alkaline pH ranges only lead to small amounts of delignification. If a quinone component is added in these methods, delignification is improved to significantly lower lignin residue percentages, but the remaining lignin percentage is still too high to achieve bleaching to high degrees of whiteness under economical conditions. If either pulping or bleaching is carried out under extremely severe conditions, usually not feasible on an industrial scale, acceptable results may be achieved, but the yield and especially the strength of the fibres are drastically reduced.

This is why, in practice, fibres made with the AS-AQ method (alkaline sulfite method with anthraquinone) and the NS-AQ method (neutral sulfite method with anthraquinone) are primarily used for unbleached or semi-bleached cellulose products. These cellulose products, characterized by a high lignin residue content, but with excellent yield and good strength, are suitable, for example, for the manufacture of corrugated cardboard products.

It is therefore an object of the present invention, to provide a method for delignifying lignocellulosic raw materials, wherein by using sulfites as a lignin-degrading component for pulping methods in the neutral or alkaline ranges the lignin residue content may be minimized.

This object has been achieved by having sulfites in the presence of an alkaline component, in particular sodium hydroxide or sodium carbonate or a mixture thereof, in aqueous solution with the application of high temperature and high pressure, cause extensive delignification by adding a first portion of the alkaline component to the aqueous solution at the beginning of the pulping process and by adding at least a second portion of the alkaline component to the aqueous solution at the beginning of delignification or later. A significant reduction of the pH value during heating is accepted quite deliberately, it is even essential for maximizing lignin degradation.

Sodium hydroxide (NaOH) or sodium carbonate ($Na_2CO_3$) is primarily used as the alkaline component, potassium or ammonium compounds, however, are also suitable.

The numerous references on sulfite pulping in neutral and alkaline ranges agree that all pulping chemicals, i.e. the sulfite, the alkaline and, if necessary, also the quinone component are added to the aqueous solution at the beginning of the pulping, i.e. before heating to pulping temperature. Increasing the overall percentage of chemicals, which means adding great quantities of sodium hydroxide, usually leads to a low, albeit stagnating at a high level, residual lignin content. The use of extreme quantities of sodium hydroxide may result in fibres bleached to a high degree of whiteness, but the fibres are severely damaged, leading to drastic losses in viscosity, and therefore strength. Persons skilled in the art, when dealing with maximum delignification, therefore always recommend keeping alkaline content as high as possible from the start. This opinion is supported by the fact that pH values are significantly reduced when the main delignification phase ends. It is considered essential to keep the level of the alkaline component as high as possible before the beginning of the pulping, in order to remove enough lignin for the wood to be decomposed into fibres.

DE 1 815 383 (to Ingruber) is particularly clear about this. Ingruber teaches to control pH values from the beginning of the pulping, and to ensure that the high alkaline pH value set at the beginning of pulping is maintained invariable by constantly adding NaOH during the heating and also in the subsequent steps of pulping. The pulping results disclosed in this reference show that while the wood mass may be pulped with a low residual lignin, using extreme amounts of chemicals, at a not economically feasible level, of 50% with absolutely dry wood mass, at the price of low yields and extraordinary losses of strength.

As exemplary references for the prior art alkaline and neutral sulfite methods, the following publications are cited: SA patent 77/3044, (1977); U.S. Pat. No. 4,213,821; JP 112903; EP 0 205 778; Gierer, I., "Über den chemischen Verlauf der Neutralsulfitkochung" ("On the chemical profile of neutral sulfite cooking"), Das Papier 22, Volume 10A, from p. 649 (1968); Gellerstedt, G. "The reaction of lignin during sulfite pulping" Svenrsk Papperstidning 79, from p. 537 (1976); Gierer, I., Lindeberg, O. and Noren, I. "Alkaline delignification in the presence of anthraquinone/anthrahydroquinone", Holzforschung 33, pp 213–214 (1979); Ojanen, E., Tuppala, Virkola, N. E. "Neutral Sulphite Anthraquinone (NS-AQ) Cooking of Pine and Birch Wood Chips", Paperi ja Puu 64, from p. 453 (1983); Virkola, N. E., Pusa, R., Kettunen, J. "Neutral Sulphite AQ Pulping as an alternative to Kraft pulping" TAPPI 64, from p. 103 (1981); Tikka, P., Tuppala, J. Virkola, N. E. "Neutral Sulphite AQ pulping and bleaching of the pulps" TAPPI International Sulfite Pulping Conf. Proceedings, from p. 11 (1982); Raubenheimer, S., Eggers, S. H. "Zellstoffkochung mit Sulfit und Anthrachinon" ("Cellulose cooking with sulfite and anthraquinone"), Das Papier 34, vol. 10A, from p. V19 (1980); Ingruber, O. V., Stredal, M., Misted, J. A., "Alkaline Sulphite—Anthraquinone Pulping of Eastern Canadian Woods", Pulp & Paper Magazine of Canada 83, Vol. 12, from p. 79 (1981); Ingruber, O. V., "Alkaline Sulphite Anthraquinone Pulping", TAPPI International Pulping Conference, Hollywood, Proc. Vol. II, from p. 461, (1985); Cameron, D. W., Jessupa, B., Nelson, P. F., Raverty, W. D., Samuel, E., Vanterhoeck, N., "The response of pines and eucalyptus to NSSC-AQ-Pulping" Ekman Days 1981, Stockholm, Vol. II, from p. 64; Suckling, I. D., "The role of anthraquinone in sulphite-anthraquinone pulping", TAPPI Wood and Pulping Chemistry Symposium, Proceedings, from p. 503 (1989); U.S. Pat. No. 5,409,570 describes adding of NaOH before an oxygen stage which is carried out subsequent to the chemical pulping.

It is all the more surprising therefore that adding alkaline components in at least two portions at a time interval (alkali splitting) results in delignification can be continued until very low residual lignin is achieved, wherein the yields remains stable, or may even be increased, and losses in strength may be avoided. As an indicator for the condition of the cellulose, the viscosity also shows improved values in spite of the reduced residual lignin. The at least one second portion of the alkaline component should not be added before the beginning of delignification. This process starts as early as a few minutes after the beginning of pulping, during the heating of the lignocellulosic raw material and the aqueous solution containing the pulping chemicals. The advantageous effect of alkali splitting is more noticeable the later the at least one second portion of the alkali component is added, where there is a broad optimum range for the maximum pulping temperature.

Contrary to previous knowledge of persons skilled in the art, it has turned out to be advantageous to accept a reduction of the pH value while heating to the maximum pulping temperature. For Example with an initial pH value of 13.0 set at the beginning of pulping, the pH value is reduced depending on the alkaline component added at the beginning of the pulping process to values of pH 8.0 (12.5 wt. % of the overall amount of the alkaline component added at the beginning of the pulping process) to pH 10.75 (50 wt. % of the overall amount of the alkaline component added at the beginning of the pulping process). However, if 100 wt. % of the alkaline component is added already at the beginning of the pulping process, pH values will only fall to about pH 12.9. The aforementioned values were obtained with pulping of spruce wood with an overall percentage of chemicals of 27.5 wt. % with absolutely dry wood, wherein the alkaline component represented 40 wt. % of the overall chemicals used.

If the neutral or alkaline sulfite pulping is carried out adding a quinone component, preferably antraquinone, the residual lignin may e reduced significally by splitting the addition of the alkaline component, while the desired high yields are achieved together with excellent strength characteristics and high viscosities. The quality of the pulp is not degraded if the aqueous solution used for pulping the lignocellulosic raw material contains at least one sulfite component. Acceptance of sulfite components reduces the purity requirements of the chemicals used for pulping leading to a generally more economical process. A further advantage with respect to the degree of delignification and the quality of the fibers, such as strength, viscosity and yields, is achieved if an alcohol, preferably a low-boiling alcohol, such as methanol or ethanol, is added to the aqueous solution.

An extraordinary advantage of the method according to the invention is that the technical facilities installed in practice may be left essentially unchanged. Except for the apparatus for adding the second portion of the alkaline component, the facilities for pulping the raw material and also for reprocessing the aqueous solution containing the pulping chemicals remain unchanged. The complex equilibrium of the pulp and especially the recovery of the pulping chemicals, is not disturbed. The overall volume of the aqueous solution containing the pulping chemicals need not be changed so that no adjustments must be made to the evaporator or the like.

The energy balance of the pulping process is improved, however, since a greater amount of decomposed lignin is available for energy generation and because less energy and/or a smaller amount of chemicals are required for cellulose bleaching.

According to the teachings of the present invention it has proven advantageous for the at least one second portion of the alkaline component to be added after the pH value of the aqueous solution has fallen during the heating process, at least by an amount of pH 0.3, preferably by an amount of pH 0.5, more advantageously by an amount of pH 1.0, most advantageously by an amount of at least pH 1.5, each time with reference to the initial pH value of the pulp. While advantageous effects with respect to cellulose characteristics and yields become sufficiently clear when the at least one second portion of the alkaline component is added at a relative early stage, i.e. at a pH value difference of at least 0.3 with reference to the initial pH value, the positive effects with respect to the cellulose characteristics and yields are greater if the at least one second portion of the alkaline component is only added after the pH value of the aqueous solution has fallen by an amount of at least pH 1.0, more advantageously by at least pH 1.5, vis-à-vis the initial pH value.

It has proven advantageous for the addition of the at least one second portion of the alkaline component to be carried out only after at least 30% of the portion of the alkali originally used is used up, i.e. is no longer detectable in the aqueous solution containing the chemicals used for pulping. Another improvement of the pulping result, in particular lignin decomposition, can be expected if before the addition of the at least one second portion of the alkaline component, a minimum of 90%, preferably 95%, of the alkali added with the first portion, are used up.

Delaying the addition of the at least one second portion by as little as 10 minutes after the beginning of the pulping process already improves the fibre characteristics and yields of the lignocellulosic raw material. A further time delay between the beginning of the pulping process accompanied by the addition of the first portion of the alkaline component, and the addition of the at least one second portion of the alkaline component shows further significantly improved cellulose characteristics and good yields within a broad time range. Advantageously, the at least one second portion of the alkaline component is added no sooner than 30 minutes, more advantageously not before than 60 minutes, most advantageously no sooner than 90 minutes after the beginning of the heating.

The addition of the at least one second portion of the alkaline component after a temperature of at least 75° C. has been reached by heating the aqueous solution containing the pulping chemicals and the lignocellulosic raw material causes an improvement of the fibre characteristics and the yields as compared with a pulping process, which is carried out identically, yet without alkali splitting. Significant improvements of the cellulose quality and the yields are achieved by adding the at least one second portion of the alkaline component after a temperature has been reached of 110° C. or higher, more advantageously of 140° C. or higher, most advantageously of 175° C. or higher.

The lignocellulosic raw material and the aqueous solution containing the sulfite and the alkaline and, where applicable, the quinone components, i.e. the aqueous solution containing the pulping chemicals, is collectively heated to the maximum pulping temperature. It has been found to be particularly effective for the at least one second portion of the alkaline component to be added only after the maximum pulping temperature has been attained. If the addition of the at least one second portion of the alkaline component is triggered, for example, by a process control, it is conceivable that the addition of the at least one second portion is activated, for example, when a minimum temperature of 150° C. is reached, or when a predetermined situation depending on the raw material and other pulping parameters used, occurs, such as pH value or time.

Cellulose with good strength and low residual lignin is obtained when pulping is carried out for a duration of 90 minutes or longer, preferably 120 minutes or longer, advantageously 150 minutes or more or, most advantageously 360 minutes or longer. The overall duration of the pulping process is relatively short, lasting only between 90 and 360 minutes, which is due to the fact that in the method according to the invention, delignification occurs already to a considerable degree during the heating phase by a reduction of the pH value and that further delignification, after adding the at least one second alkaline portion, is well prepared.

A preferred embodiment of the method according to the present invention provides for the pulping of the lignocellulosic raw material in the aqueous solution containing the sulfite and the alkaline component and, if applicable, the quinone component, to be carried out with a pulping duration of at least 30 minutes, preferably between 60 and 360 minutes, more advantageously between 120 minutes and 180 minutes, at a maximum pulping temperature.

Even though the degree of delignification is increased, the duration of the pulping process at maximum temperature can be made short. With raw materials having low lignin content, such as annual plants or hardwoods with little lignin content, as little as 30 minutes may be sufficient. When pulping wood chips, the duration of the pulping process is preferably between 60 and 180 minutes, usually between 120 and 150 minutes, at maximum temperature. If for technical reasons, a relatively low pulping temperature between 160° C. and 170° C., is chosen, for example, it may be necessary to increase the pulping time to 300 minutes at maximum temperature.

The pulping process in which the alkaline component is added in at least two portions at a time interval may be carried out using relatively mild conditions. At a pulping temperature of as little as 150° C., for example, bleachable celluloses may be obtained after 60 minutes. Preferably, the maximum pulping temperature is between 160° C. and 180° C. If the lignocellulosic raw material is hard to pulp, the temperature may be increased, wherein the economical limit is about 190° C.

In the most basic case, the first and second portions of the alkaline component can be about equal, i.e. about 50 wt. % at the beginning of the pulping process and about 50 wt. % when the maximum pulping temperature is reached, for example. It came as a surprise then that adding as little as about 15 wt. % as the first portion of the alkaline component at the beginning of the pulping process and a later dosage of 85 wt. % as the second portion of the alkaline component leads to excellent delignification results.

According to the present invention, the effect of extensive delignification is achieved when the first portion of the alkaline component is between about 15 wt. % and about 80 wt. %, and when correspondingly about 85 wt. % to about 20 wt. % of the alkaline component are added as a later dose of the at least one second portion. Of particular advantage is a separation between about 75 wt. % to about 30 wt. % of the alkaline component at the beginning of the pulping process and between about 25 wt. % and about 70 wt. % of the alkaline component after the beginning of the delignification. Preferably, between about 60 wt. % and 40 wt. % are added as the first portion of the alkaline component and between 40 wt. % and 60 wt. % as the second portion of the alkaline component. In particular, about 50 wt. % of the alkaline component as each of the first and second portions have proven to be maximally effective for delignification while at the same time being mild on the cellulose fibres.

The overall percentage of chemicals, i.e. sulfite with alkaline component and, if applicable, quinone or sulfide components, and, if applicable, the addition of alcohol, can be kept low. With raw materials having a low lignin content, as little as 18 wt. % or more overall percentage of chemicals with absolutely dry wood is sufficient to achieve extensive delignification. If hard-impregnating wood with a high lignin content is to be pulped, as much as 45 wt. % overall chemicals with absolutely dry wood must be used. Depending on the raw material, the overall percentage of chemicals can be chosen from a wide range. Good delignification results can be achieved with an overall percentage of chemicals of between about 22 wt. % and about 45 wt. %, preferably with an overall percentage of chemicals of between about 25 wt. % and about 35 wt. %, advantageously of between about 28 wt. % and about 32 wt. %. For conifer wood, generally an overall percentage of chemicals of between 22 and about 30 wt. %, preferably between about 25 and about 28 wt. % with absolutely dry wood is sufficient; for hardwoods, the overall percentage of chemicals may vary widely between about 20 and about 30 wt. % depending on the kind of wood.

Regardless of the overall percentage of chemicals chosen, the ratio between sulfite and the alkaline component can be widely adjusted. Since the quinone component added as needed is only used in minimal amounts, it is negligible for adjusting the ratio of sulfite to alkali. A ratio of sulfite to alkali components in a range of between 80 to 20 and 40 to 60 is suitable to obtain celluloses of good quality. A ratio of sulfite to alkaline component of between 70 to 30 and 50 to 50, in particular 60 to 40, is preferred. The splitting of the overall quantity of the pulping chemicals, i.e. sulfite and alkaline component, can be adjusted, as needed, depending on the lignocellulosic raw material and the parameters of the pulping process chosen (temperature, duration).

While splitting the alkali into two portions is already sufficient to obtain excellent celluloses with a low residual lignin content and good yields and strength characteristics, the splitting into three, four or more portions can also achieve extensively delignified celluloses with high yields and good strength results.

The invention is also directed to a cellulose, obtained by the method for delignifying according to at least one of the preceding claims, in particular cellulose with a residual lignin after pulping of less than kappa number 35, preferably less than kappa number 30, more preferably less than kappa number 25, most preferably of less than kappa number 20. The low residual lignin ensures good bleachability. Good bleachability is characterized by the use of small amounts of bleaching chemicals and/or small energy consumption to achieve degrees of whiteness above 88% ISO.

Within the scope of the present invention, a cellulose is obtained according to the above described method of delignifying with a residual lignin content after pulping of less than kappa number 35 and an accept yield of at least 45%, preferably at least 50%, both with absolutely dry wood, preferably a kappa number of less than 30 and an accept yield of at least 45%, preferably at least 50%, both with absolutely dry wood, advantageously a kappa number of less than 25 and an accept yield of at least 43%, preferably at least 46%, both with absolutely dry wood, most advantageously a kappa number of less than 20 with an accept yield of at least 43%, more advantageously at least 46%, both also with absolutely dry wood. As described above, the mildness of pulping process can be seen in the fact that lignin is removed selectively without excessively degrading or decomposing the fibres, in particular cellulose or hemicellulose.

First attempts involving a short chlorine-free bleaching sequence (O Q(OP) Q P) of the cellulose manufactured according to the method of the present invention show that a fully bleached cellulose can be manufactured with a degree of whiteness of above 88% ISO and with strength characteristics that are reduced by as little as 5% vis-à-vis unbleached cellulose. This proves the high selectivity.of the method of the present invention, whereby the carbohydrate component of the raw material, which in prior art pulping methods is often heavily damaged initially and is then significantly decomposed during bleaching, remains largely intact in the present mild pulping method.

Details of the method of the present invention are explained as an example using the tests described below.

The parameters obtained in the Examples below, such as residual lignin, degree of whiteness, viscosity and strength characteristics, were determined using the standard procedures as follows:

The viscosity was determined according to Merkblatt (Code of Practice/CP) IV/36/61 of the Verein der Zellstoff- und Papier-Chemiker und—Ingenieure (Zellcheming) ("Association of Cellulose and Paper Chemists and Engineers"). The degree of whiteness was obtained by manufacturing test sheets according to Zellcheming CP V/19/63; measurements were taken according to SCAN C 11:75 with an elrepho 2000 type photometer; the whiteness is given in percent according to ISO standard 2470. The residual lignin (kappa number) was determined according to Zellcheming CP IV/37/63. The technological characteristics of the paper were determined using test sheets manufactured according to Zellcheming CP V/8/76. Unit weight and tearing strength were determined according to Zellcheming CP V/11/57 and V/12/57. The tear factor was obtained according to DIN 53 128 Elmendorf. The freeness was measured according to Zellcheming CP V/3/62. The yield was calculated by weighing the raw material used and the cellulose obtained after pulping, which was dried at 105° C. to constant weight (absolutely dry). The measurement of the tensile, tear and burst indices was carried out according to TAPPI 220 sp-96.

In all of the following Examples, the indications on the overall percentage of chemicals and the splitting of the sulfite component and the alkaline component are calculated as NaOH.

EXAMPLE 1

Figure 1:
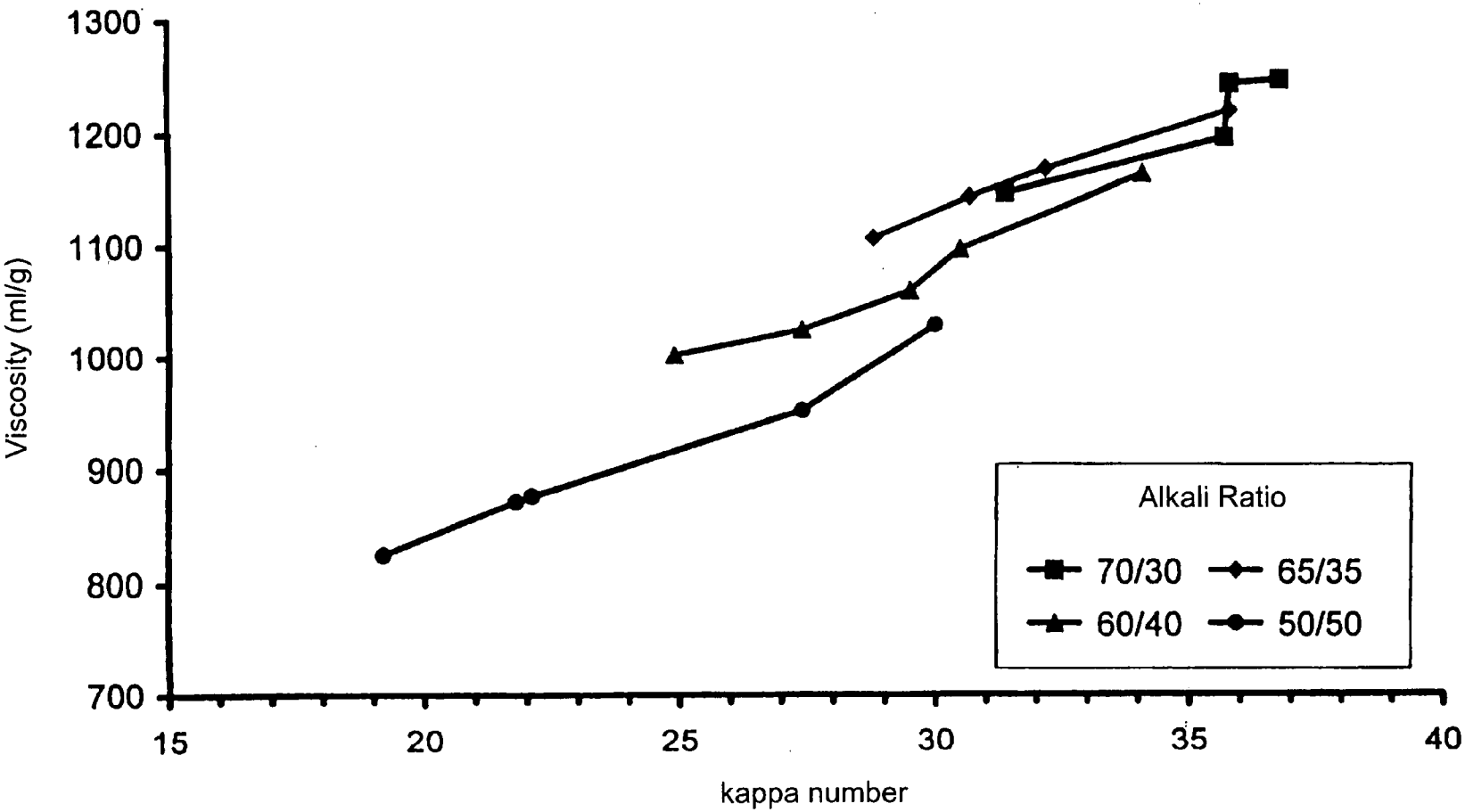
FIG. 1 shows viscosity vs. kappa number for alkaline sulfite pulping with anthraquinone at different alkali ratios of sodium sulfite to NaOH.

Pine-wood chips were mixed with an alkaline sodium sulfite pulping solution after vaporization (30 min. with saturated vapour at 105° C.) at a liquid-to-solid ratio of 4 to 1. The overall percentage of chemicals with absolutely dry wood was 27.5 wt. %. The alkali ratio of sodium sulfite to NaOH was adjusted to 60 to 40. In the above preliminary study with reference to FIG. 1 regarding the alkaline sulfite pulping with antraquinone, this ratio has proven to be a good compromise between maximum delignification and minimum viscosity loss. FIG. 1 shows quite clearly, however, that a wide range of mixing ratios for the sulfite component and the alkaline component lead to good pulping results. The preliminary studies were carried out under the reaction conditions as outlined in Example 1, wherein, however, 100% of the sodium-hydroxide solution was added at the beginning of the pulping process.

It was not until the "modified" tests shown in Table 1 that the NaOH amount was divided. Half of the amount of sodium hydroxide solution was added to the pulping solution as a first portion (50%) together with the sodium sulfite and 0.1 wt. % anthraquinone with absolutely dry wood. The raw materials and the pulping solution was then heated for 90 minutes to reach 175° C. Then the second portion of the NaOH (50%) was added in an aqueous solution. This increases the liquid-to-solid ratio to 5 to 1. The pine-wood chips were then pulped at 175° C. for 150 minutes. Subsequently the cooker was degassed, cooled down to below 100° C., and the pulp was taken out. It is washed, the chips are ground in a pulper and thus disintegrated into fibres. The fibres are sorted in a slot sorter. Then the yield, residual lignin (expressed in a kappa number), degree of whiteness, tearing strength and bursting strength were analysed. The results are shown in Table 1 in the line labelled "modified".

As a reference Example, conventional alkaline sulfite cooking was carried out. Raw materials and test conditions corresponded precisely to the ones of Example 1, except that 100% NaOH is added before heating. The time and temperature profile of the reference Example also corresponded to the time and temperature profile of Example 1. The processing and analysis of the pulp was carried out in the same manner as in Example 1. The results are shown in Table 1 in the line labelled "standard".

EXAMPLE 2

Under the same conditions as in Example 1, spruce-wood chips were pulped instead of pine-wood chips. Temperature and time profile and processing and analysis matched the conditions indicated for example 1. The reference pulping carried out with spruce-wood chips was carried out, processed and analysed under the conditions indicated for example 1. The results are shown in Table 2.

EXAMPLE 3

Spruce chips were pulped again using an alkaline sulfite solution at a maximum temperature of 175° C. for 150 minutes. The maximum temperature was reached after a heating-up phase of 90 minutes. The overall percentage of chemicals was 27.5 wt. % with absolutely dry wood, and an additional 0.1 wt. % anthraquinone. The ratio of sodium sulfite to NaOH was 60 to 40. 25 wt. % of NaOH were added before the heating phase as a first portion. 75 wt. % of NaOH were added in an aqueous solution after 90 minutes when the maximum pulping temperature of 175° C. was reached. The processing and analysis of the test described in Example 3 were carried out as described in Example 1. The results of this test are compiled in Table 3 in the line labelled "modified".

EXAMPLE 4

An alkaline sulfite pulping process with the addition of a first portion before heating and the addition of a second portion after the maximum temperature of the pulp has been reached can still be improved with respect to delignification and selectivity by adding a low-boiling alcohol (ASAM process with split addition of the alkali component).

Spruce chips were pulped under the conditions of Example 3, where the aqueous pulping solution, which was provided with a dose of just 25% of all the alkali before heating, was then dosed with 10 vol. % methanol with absolutely dry wood. The processing and analysis were carried out as described in Example 1. The results of this test are described in the line labelled "ASAM modified" in Table 3.

When comparing the results shown in Tables 1 to 3, it is evident that the yield is hardly reduced in spite of the significantly reduced residue, or, in the case of the modified test of Example 2, has even been stabilized. Since delignification was continued here with residual lignin which in a "standard" test would have been achievable only with much more severe conditions, if at all, and would have led to a drastic reduction in yield, this shows an extraordinary advantage of the method according to the present invention.

The viscosities achieved are another advantage of the extremely selective methodology of the present invention, i.e. essentially directed to the decomposition of lignin rather than cellulose or hemicellulose. Viscosity is an indicator for the state of the cellulose at the end of the pulping process. With the "modified" tests of the present invention, values above the viscosities of the "standard" tests are obtained on a regular basis. If the viscosities of the tests under "modified" conditions are set in relation to the extremely low content of residual lignin (kappa number), it is evident how mild the effects of the method according to the present invention are on fibres.

The strength characteristics of the celluloses pulped in the "modified" way also have the same or improved values as compared with the fibres manufactured according to the reference tests. Again it is to be noted that this high level of strength is maintained at a much lower residual lignin content. If prior art delignification methods remain unchanged or if more severe pulping conditions are used until such low residual lignin values—to kappa numbers below 25—are reached, if they are reached at all, a drastic reduction in viscosity and strength values can be observed, since toward the end of the pulping, not only the lignin remaining in the raw material, but also the cellulose and hemicellulose are degraded and decomposed.

Particular note should be taken of the results of the modified ASAM pulping in Table 3, where an exceptionally low residual lignin content is obtained with a yield considerably above 47%, with high viscosity and strength values. This cellulose therefore has the best possible preconditions for bleaching to high degrees of whiteness at low percentages of chemicals used.

For other cellulose manufactured according to the "modified" methods according to the present invention shown in Tables 1 to 3, it also applies that with the extensively reduced residual lignin contents it is also possible to bleach to high degrees of whiteness using the usual chlorine-free processes such as oxygen, ozone or peroxide bleaching. Since the cellulose manufactured using sulfite, while showing low delignification, already has relatively good possibilities of decomposable residual lignin, it may be expected that the fibres manufactured according to the modified method according to the present invention are capable of being bleached with low energy consumption while achieving good viscosity and strength characteristics.

EXAMPLE 5

Spruce chips were pulped in an alkaline sulfite pulping process where the reaction conditions matched those of Example 1, except that anthraquinone was not added. The content of residual lignin, as shown in Table 4, had a kappa number of 92.8, which was considerably above what would be acceptable for further processing. This test shows that even when compared with a pulping process where all of the alkali component is added at the beginning of the pulping and a residual lignin content with a kappa number of 100 or more is expected, the positive effect of splitting the alkaline addition can be observed even under these severe pulping conditions.

EXAMPLE 6

In two tests, the process temperature of 175° C. was lowered to 170 and 165° C., respectively, wherein the duration of the pulping process at 170° C. was extended to last 210 minutes, and at 165° C. to last 270 minutes, while the remaining process conditions of Example 1 were left unchanged.

The results are shown in Table 5. The lowering of the process temperature still results in selective processing despite longer pulping. The residual lignin is stabilised at a low level while, at the same time, the yield and viscosity and, associated with the higher viscosity, the strength characteristics are improved.

EXAMPLE 7

Beech wood was pulped with an overall percentage of chemicals of 27.5 wt. % with absolutely dry wood at a ratio of sulfite to NaOH of 50 to 50 at 150° C. The beech chips were heated together with the pulping solution for 90 minutes to reach a maximum pulping temperature of 150° C. 0.1 wt. % anthraquinone (AQ) was added to the pulping solution. The liquid-to-solid ratio was 4 to 1 at the beginning of the pulping process. The effect of the first portion of the alkaline component (NaOH) was studied, which was varied between 0 and 100% in steps of 12.5 wt. %. When the maximum pulping temperature was reached, the second portion of the alkaline component was added.

Figure 2:
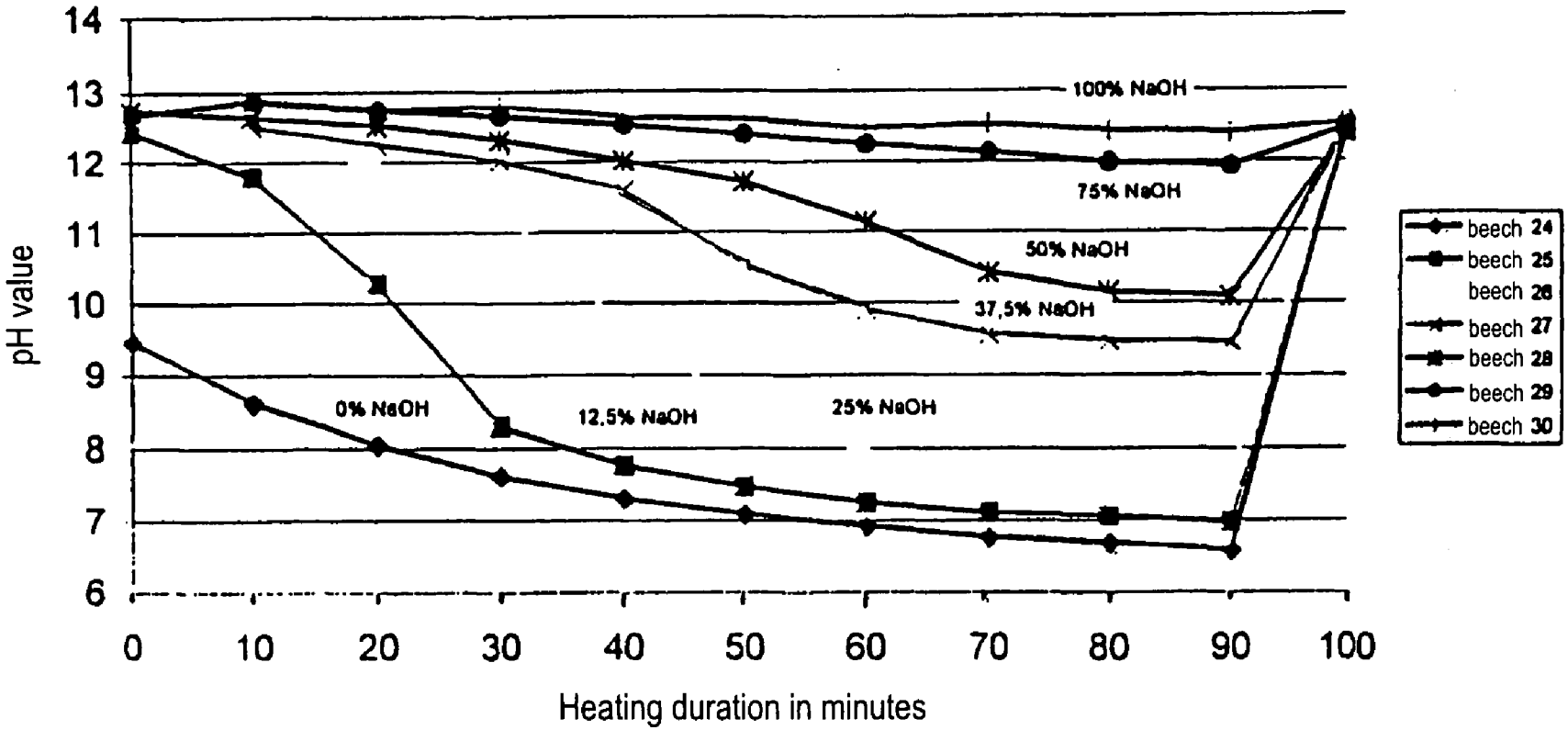
FIG. 2 shows a profile of pH value of alkaline pulping solution during heating phase of ASA beech wood cooking as a function of NaOH use.

FIG. 2 clearly shows the reduction of the pH value during heating. This is most noticeable when the first portion of the alkaline component is 25 wt. % or less. Table 6 shows the results of these pulping processes, evaluated for the parameters of yield (accept and splitter), kappa number, viscosity, end-pH value (pH value at the end of the pulping process at maximum temperature), degree of whiteness, tearing strength and tear factor. The tests no. 31, 32 and 39 are repetitions of tests 26 to 28.

The degradation or reduction of the characteristics of the cellulose after a reduction of the pH value during heating and pulping at maximum temperature which would have to be expected according to the prior art (cf. Ingruber, in particular), do not in fact occur. If the chosen pulping conditions are used, it can be shown that when beech wood is pulped, the alkali splitting leads to improved yields with a similarly low residual lignin content (kappa number) and a high degrees of whiteness, when the first portion is as high as 37.5 wt. % of NaOH.

EXAMPLE 8

Spruce wood was pulped with an overall percentage of chemicals of, again, 27.5 wt. % with absolutely dry wood at a ratio of sulfite to NaOH of 60 to 40 at 175° C. The spruce chips were heated together with the pulping solution for 90 minutes to reach a maximum pulping temperature of 175° C.

0.1 wt. % anthraquinone (AQ) was added to the pulping solution. The liquid-to-solid ratio was 4 to 1 at the beginning of the pulping process. The pulping conditions thus matched those of Example 1.

The effects of varying the first portion of the alkaline component (NaOH) between 0 and 100% in steps of 12.5 wt. % were studied. When the maximum pulping temperature was reached, the second portion of the alkaline component was added.

Figure 3:
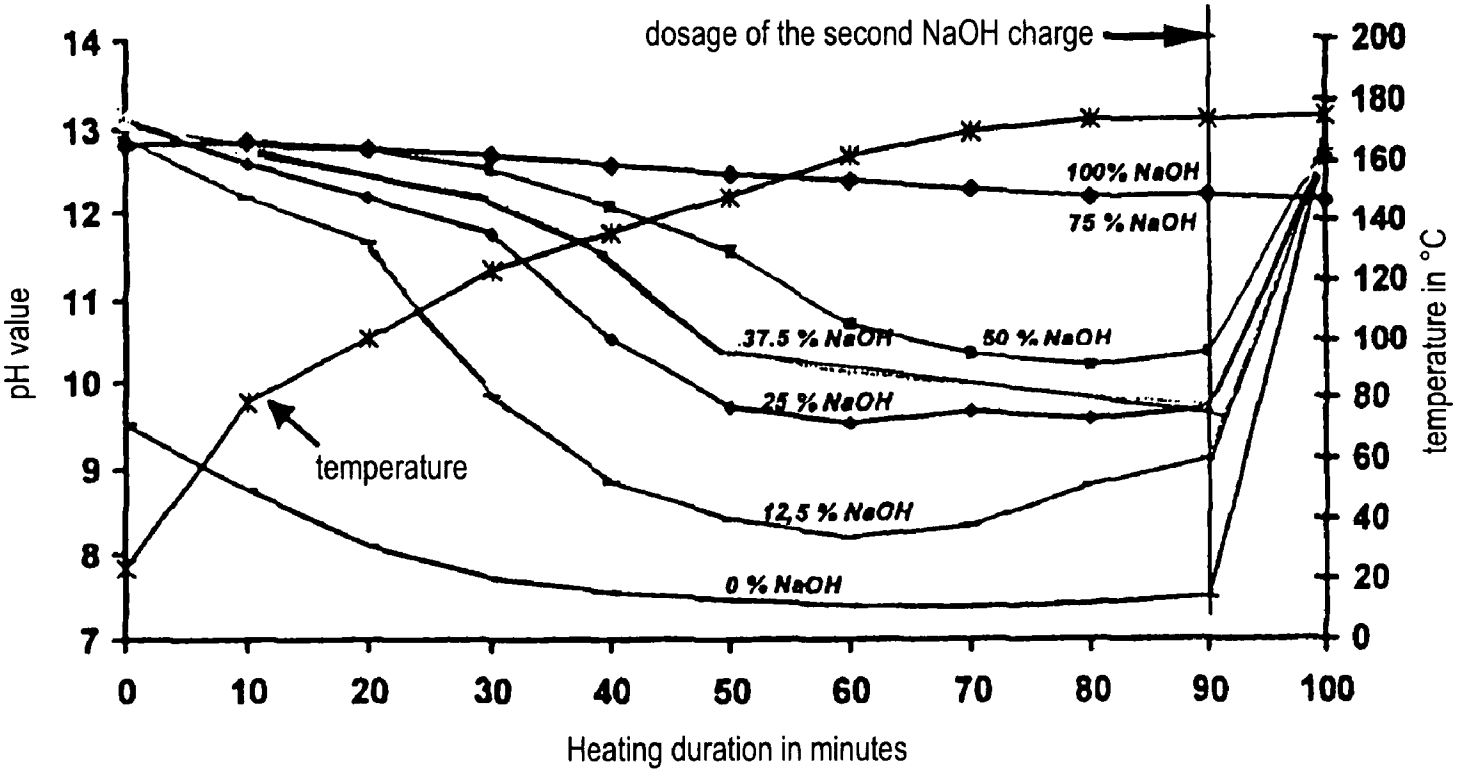
FIG. 3 shows a profile of pH value of alkaline pulping solution during heating phase of ASA spruce cooking as a function of NaOH use.

FIG. 3, just like FIG. 2, clearly shows the reduction of the pH value during heating. This is most noticeable for pulping spruce wood when the first portion of the alkaline component is 12.5 wt. % or less. Although the pH value is reduced minimally during the entire pulping process when 100% of the alkaline component is added from the beginning, it can be seen, that when alkali splitting is used, the pH value is significantly reduced, in particular during the heating phase; according to Ingruber, this effect is supposed to be deleterious, for extensive delignification, however, it turns out to be essential. If the first portion of the alkaline component is only reduced to 75% of the entire amount, a reduction of the pH value by about 0.5 vis-à-vis the initial pH value can be seen. The reduction of the pH value is more noticeable if only 50% of the NaOH or less is added at the beginning of the pulping process. The pH value falls from about 13.1 at the beginning of the pulping process to a minimum value of about pH 8.5 during the heating phase. Once this point has been reached, the second portion of the alkaline component is added, resulting in an extensively delignified cellulose with high strength and high yields.

Table 7 shows the results of these pulping processes, evaluated for the parameters of yield (accept and splitter), kappa number, viscosity, end-pH value (value of pH at the end of the pulping process at maximum temperature), degree of whiteness, tearing length and tear factor.

With the pulping conditions chosen, when spruce is pulped and a first portion of NaOH of just 12.5% is used, alkali splitting results in a small residual lignin content (kappa number) and an improved degree of whiteness. In addition, the strength values are better when the alkali is divided than when 100% of the alkali is added "from the start". The tear factor in particular, has good values. The overall high strength level can be seen from the significantly higher viscosity values. The end-pH value of all pulping processes does not show any variations, i.e. does not reflect the varied pH-value profile of the cooking process. It should be noted that all pH value measurements were carried out at room temperature.

FIG. 3 illustrates a pulping process in which the second portion of the NaOH was added after 90 minutes. It has been shown, however, that the effects measured, i.e. the advantages of the method according to the present invention, may already be seen in the manufactured cellulose, if the second portion of the alkaline component is added after a reduction in the pH value has been measured. The same applies to a minimum temperature reached during the pulping process or during the heating process: the addition of the second portion of the alkaline component at a minimum temperature of 75° C., preferably of 100° C., advantageously of 140° C., results in a cellulose, with a lower lignin content, better strength characteristics and higher yields when compared to cellulose manufactured without alkali splitting.

EXAMPLE 9

The effect of alkali splitting is particularly noticeable in the pulping of pine. The process conditions for pulping the pine chips are exactly those as chosen in Example 8 for spruce.

Table 8 shows that when a first portion of NaOH—between 25% and 50% of the entire amount—is added at the beginning of the pulping process, a significantly lower level of residual lignin is obtained with a nearly unchanged yield, a high overall strength and a considerably improved degree of whiteness.

EXAMPLE 10

Eucalyptus wood was pulped with an overall percentage of chemicals of 27.5 wt. %, with a ratio of sulfite to alkali of 50 to 50 at a maximum pulping temperature of 165° C. Maximum pulping temperature was reached in 90 minutes. A first pulping process without alkali splitting (so-called standard cooking) and a second pulping process where a first portion of NaOH of 50 wt. % at the beginning of the pulping process and a second portion of 50 wt. % was added after reaching the maximum pulping temperature of 165° C. after 90 minutes were carried out in parallel. The results of these cooking processes show that the standard cooking process results in cellulose with a kappa number of 16.8 while the alkali splitting leads to a kappa number of 14.8. The degree of whiteness of the pulping process with alkali splitting is 32.7% ISO, which is above the result of the standard cooking process at 31.9% ISO. In spite of the low residual lignin content, the yield of the pulping process with alkali splitting is an accept 51.3% with absolutely dry wood. This is only a little less than the result of the standard cooking process, which has a yield of 52.0% accept with absolutely dry wood. "Accept" means the yield of fibres passing through the slot sieve with an aperture size 0.15 mm after pulping.

EXAMPLE 11

The NaOH was added in 4 equal doses of 25% each, wherein a first portion was added at the beginning of the pulping process, a second portion after 40 minutes (at about 140° C.), a third portion after 90 minutes when the maximum temperature was reached, and a last portion of 25% after 120 minutes, i.e. 30 minutes after the maximum temperature was reached. The remaining conditions of Example 1 were left unchanged.

The cellulose pulped using four equal portions of NaOH shows a very low residual lignin content, even lower than the one obtained using two portions of NaOH, as shown in Table 5. Yield and viscosity, i.e. also the strength characteristics, are at a very high level. This is a result which is impossible to achieve with pulping processes where the entire alkali component is added at the beginning, or where the goal (cf. Ingruber) is to maintain a maximally high alkali level from the start of the pulping process.

The evaluation of the tests of the present Example 11 has shown that the addition of the at least one second portion of the alkaline component results in particularly positive effects on delignification and selectivity at a process temperature of 140° C. or more.

EXAMPLE 12

Figure 4:
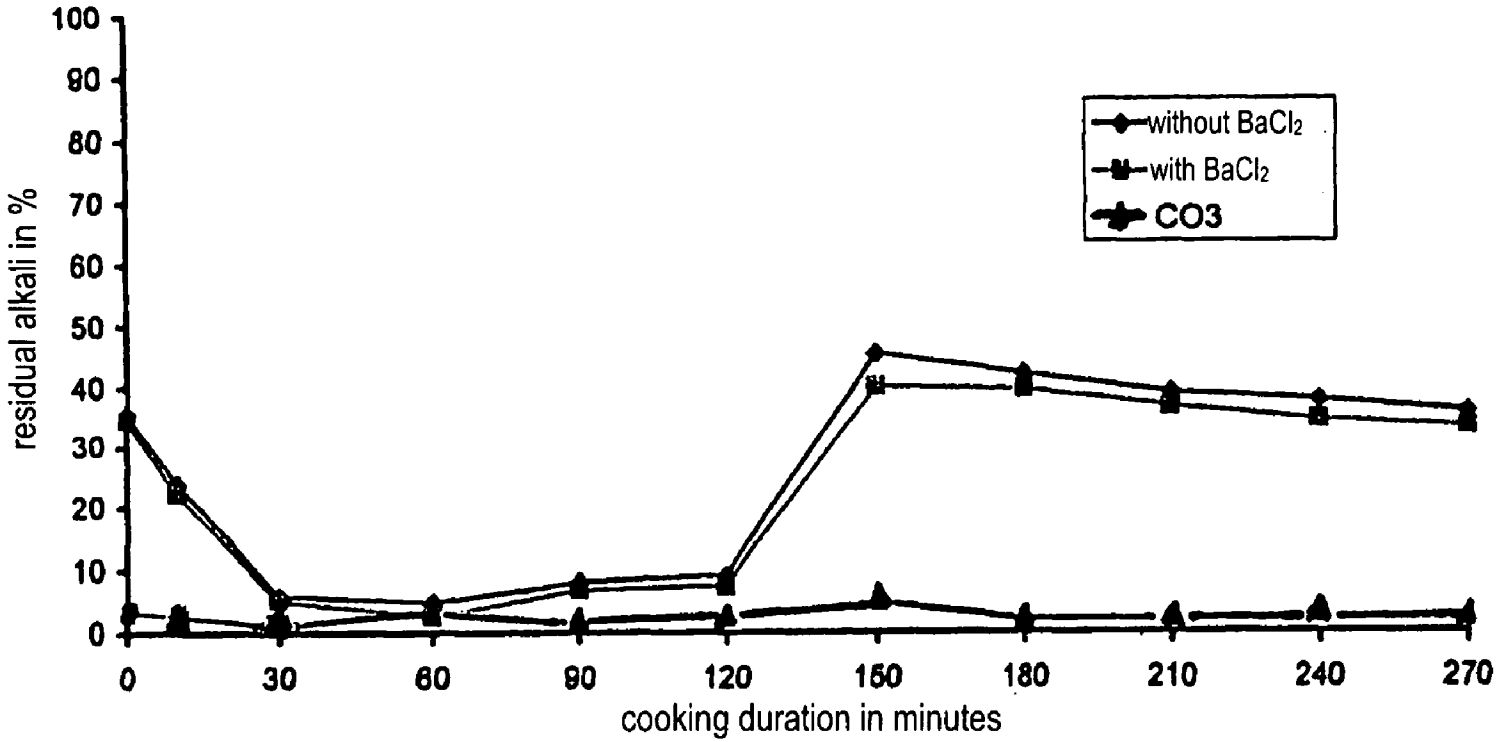
FIG. 4 shows the determination of residual alkali for the ASA pulping of spruce with alkali.

Spruce was pulped with a maximum pulping temperature of 175° C., an overall percentage of chemicals of 27.5% with absolutely dry wood. The alkali ratio was adjusted to 60 to 40 of sulfite to alkali. FIG. 4 shows how much of the alkali of the first portion—37.5% of all the alkali—was used up, which first portion is added at the beginning of the pulping process (conditions as in Example 1). The content of the remaining alkali is indicated in absolute percentages. The graphs thus show that 37.5 NaOH was added at the beginning of the pulping process, while as early as 10 minutes later only about 25% NaOH is measurable. The content of NaOH is reduced to about 5% after 30 minutes and significantly rises only after 120 minutes when the second portion of NaOH is added.

The amount of the residual alkali detectable in the aqueous solution was determined by titration. A first titration to detect the remaining NaOH was carried out using hydrochloric acid directly (without $BaCl_2$). A more accurate titration was achieved by first neutralizing the residual alkali with barium chloride ($BaCl_2$) before the titration was carried out. The $BaCl_2$ also transforms the carbonate remaining in the aqueous solution, which has an effect on the pulp. The graphs show that the residual alkali titrated with or without $BaCl_2$ vary, however, only slightly in absolute values.

As early as 10 minutes after the heating has begun, ca. 30% of the initially applied first portion of the alkali is used up. After 30 minutes of heating about 90% of the initially applied first portion of alkali is used up. After 60 minutes of heating about 95% of the initially applied alkali is used up. FIG. 4 thus shows with particular clarity how the method according to the present invention and the cellulose manufactured thereby differ from the recommendations of the prior art (according to Ingruber, in particular).

TABLE 1

Effects of modifications in pulping of an alkaline sodium sulfite pulp with the addition of anthraquinone Maximum pulping temperature: 175° C., pulping duration: 150 minutes, raw material: pine

| Test | overall yield (%) | kappa number | viscosity (mg/l) | tearing strength (km)* | tear factor (cN)* |
|---|---|---|---|---|---|
| standard | 46.9 | 31.3 | 1131 | 11.1 | 111.4 |
| modified | 46.0 | 22.9 | 1204 | 11.1 | 124.2 |

*measured at 25° Schopper Riegler

TABLE 2

Effects of modifications in pulping of an alkaline sodium sulfite pulp with the addition of anthraquinone Maximum pulping temperature: 175° C., pulping duration: 150 minutes, raw material: spruce

| Test | overall yield (%) | kappa number | viscosity (mg/l) | tearing strength (km)* | tear factor (cN)* |
|---|---|---|---|---|---|
| standard | 52.7 | 35.4 | 1154 | 12.2 | 110.8 |
| modified | 53.2 | 25.0 | 1245 | 12.2 | 117.9 |

*measured at 25° Schopper Riegler

TABLE 3

Effects of modifications in pulping of an alkaline sodium sulfite pulp with the addition of anthraquinone and methanol (for modified ASAM); maximum pulping temperature: 175° C., pulping duration: 150 minutes, raw material: spruce

| Test | overall yield (%) | kappa number | viscosity (mg/l) | tearing strength (km)* | tear factor (cN)* |
|---|---|---|---|---|---|
| modified | 46.9 | 21.4 | 1210 | 10.8 | 135.9 |
| modified ASAM | 47.7 | 16.4 | 1181 | 10.8 | 131.1 |

*measured at 25° Schopper Riegler

TABLE 4

Effects of modifications in pulping of an alkaline sodium sulfite pulp without the addition of anthraquinone Maximum pulping temperature: 175° C., pulping duration: 150 minutes, raw material: spruce

| Test | kappa number |
|---|---|
| standard | 100.0 |
| modified | 92.8 |

TABLE 5

Effects of modifications in pulping of an alkaline sodium sulfite pulp with the addition of anthraquinone Raw material: spruce

| Test | overall yield (%) | kappa number | viscosity (mg/l) | tearing strength (km)* | tear factor (cN)* |
|---|---|---|---|---|---|
| modified: 170° C., 210 min | 50.1 | 23.7 | 1297 | 11.3 | 123.3 |
| modified 165° C., 270 min | 51.8 | 27.6 | 1341 | 11.3 | 115.9 |
| modified 4 portions NaOH | 48.9 | 23.7 | 1191 | 11.1 | 127.2 |

*measured at 25° Schopper Riegler

TABLE 7

Effect of alkali splitting in ASA pulping of spruce wood (27.5% overall percentage of chemicals, alkali ratio = 60/40, 150 min at 175° C.)

| NaOH percentage at outset | accept [%] | splitter [%] | kappa number | viscosity [ml/g] | tearing strength* [km] | tear factor* [cN] | end pH | degree of whiteness [% ISO] |
|---|---|---|---|---|---|---|---|---|
| 100% | 45.7 | 2.1 | 26.7 | 1125 | 11.8 | 118.1 | 11.4 | 25.1 |
| 75% | 45.6 | 2.8 | 25.8 | 1160 | 11.4 | 119.3 | 11.3 | 26.4 |
| 50% | 45.7 | 2.7 | 23.0 | 1249 | 11.7 | 126.4 | 11.4 | 29.3 |
| 25% | 45.4 | 2.3 | 20.2 | 1228 | 11.4 | 137.2 | 11.4 | 32.6 |
| 12.5% | 45.5 | 2.3 | 21.4 | 1202 | 12.2 | 112.6 | 11.3 | 32.7 |
| 0% | 45.7 | 2.0 | 23.4 | 1116 | 10.2 | 121.2 | 11.3 | 30.7 |

*The strength values in this Table and the following Tables are interpolated values for a freeness of 25° SR.

TABLE 6

Effect of alkali splitting in ASA pulping of beech wood (27.5% overall percentage of chemicals, alkali ratio 50/50, 155° C.)

| No. | alkali dosage at outset [%] | net. yield [%] | yield [%] | accept [%] | splitter [%] | kappa number | viscosity [ml/g] | end pH | degree of whiteness [% ISO] | tearing strength [km] | tear factor [cN] |
|---|---|---|---|---|---|---|---|---|---|---|---|
| 24 | 0 | 50.1 | 52.8 | 52.2 | 0.6 | 17.9 | 1149 | 12.3 | 34.1 | 8.6 | 88.2 |
| 25 | 12.5 | 48.5 | 51.2 | 50.7 | 0.5 | 18.1 | 1159 | 12.3 | 34.9 | 8.5 | 90.1 |
| 26 | 25 | 47.8 | 51.0 | 48.8 | 2.2 | 20.9 | 1207 | 12.1 | 32.1 | 9.1 | 83.0 |
| 27 | 37.5 | 47.1 | 50.2 | 47.6 | 2.7 | 20.9 | 1229 | 12.1 | 33.4 | 9.1 | 87.9 |
| 28 | 50 | 44.7 | 47.6 | 45.2 | 2.4 | 19.9 | 1207 | 12.3 | 35.3 | 8.6 | 88.2 |
| 29 | 75 | 44.5 | 47.3 | 45.8 | 1.5 | 18.4 | 1170 | 12.2 | 32.2 | 8.7 | 90.2 |
| 30 | 100 | 45.3 | 47.9 | 47.2 | 0.7 | 17.6 | 1157 | 12.2 | 30.7 | 8.3 | 86.6 |
| 31 | 25 | 46.7 | 49.5 | 47.8 | 1.6 | 18.7 | 1174 | 11.9 | 33.9 | 8.8 | 87.3 |
| 32 | 37.5 | 45.3 | 47.8 | 47.1 | 0.7 | 16.7 | 1168 | 11.9 | 33.7 | 8.8 | 87.3 |
| 39 | 50 | 45.3 | 48.0 | 46.1 | 1.9 | 18.4 | 1223 | 12.0 | 34.4 | 8.3 | 91.6 |

TABLE 8

Effect of alkali splitting in ASA pulping of beech wood (27.5% overall percentage of chemicals, alkali ratio 60/40, 150 min, 175° C.)

| NaOH percentage at outset | accept [%] | splitter [%] | kappa number | viscosity [ml/g] | tearing strength [km] | tear factor [cN] | end pH | degree of whiteness [% ISO] |
|---|---|---|---|---|---|---|---|---|
| 100% | 42.9 | 4.0 | 31.3 | 1131 | 11.1 | 111.4 | 11.2 | 25.0 |
| 75% | 42.7 | 5.3 | 28.4 | 1181 | 11.2 | 123.0 | 11.8 | 23.7 |
| 50% | 42.2 | 3.7 | 22.9 | 1204 | 11.1 | 124.3 | 10.9 | 27.8 |
| 25% | 42.5 | 3.7 | 22.0 | 1185 | 11.6 | 118.4 | 11.1 | 28.9 |
| 12.5% | 43.8 | 3.1 | 26.2 | 1171 | 10.9 | 97.1 | 11.1 | 29.6 |
| 0% | 44.6 | 3.8 | 28.0 | 1140 | 11.6 | 113.8 | 9.5 | 26.0 |

The invention claimed is:

1. A method for delignifying lignocellulosic raw materials, comprising the steps of:

providing a quantity of lignocellulosic raw materials;

determining a suitable amount of sulfites and an alkaline component for treating the quantity of lignocellulosic raw materials;

pulping the raw materials in an aqueous solution while applying heat and pressure to pulp the raw materials and begin delignification of the raw materials; and treating the raw materials with at least a portion of the suitable amount after delignification of the raw materials begins.

2. The method for delignifying according to claim 1, characterized in that said aqueous solution includes a quinone component.

3. The method for delignifying according to claim 1, characterized in that said aqueous solution further includes a sulfide component.

4. The method for delignifying according to claim 1, characterized in that an alcohol is added to said aqueous solution.

5. The method according to claim 1, characterized in that the pulping of said lignocellulosic raw material is carried out in said aqueous solution with a pulping duration of at least 90 minutes.

6. The method according to claim 1, characterized in that the pulping of said lignocellulosic raw material is carried out with said aqueous solution at a maximum pulping temperature and a pulping duration of at least 30 minutes.

7. The method according to claim 1, characterized in that the maximum pulping temperature is between 150° C. and 190° C.

8. The method according to claim 1, characterized in that for pulping the lignocellulosic raw material said sulfite and said alkaline component are adjusted in a ratio of between 80 to 20 and 40 to 60.

9. The method according to claim 1, characterized in that at least one additional. portion of the alkaline component is added to said aqueous solution after the at least one portion.

10. The method according to claim 1, characterized in that said raw material to be delignified is vaporized before said aqueous solution is added.

11. The method of claim 4, wherein the alcohol is methanol.

12. The method of claim 5, wherein pulping of the lignocellulosic raw material is carried out in the aqueous solution with a pulping duration of at least 120 minutes.

13. The method of claim 5, wherein pulping of the lignocellulosic raw material is carried out in the aqueous solution with a pulping duration of at least 150 minutes.

14. The method of claim 5, wherein pulping of the lignocellulosic raw material is carried out in the aqueous solution with a pulping duration of at least 360 minutes.

15. The method of claim 6, wherein the pulping of said lignocellulosic raw material is carried out with said aqueous solution at a maximum pulping temperature and a pulping duration of between 60 minutes and 360 minutes.

16. The method of claim 6, wherein the pulping of said lignocellulosic raw material is carried out with said aqueous solution at a maximum pulping temperature and a pulping duration of between 120 minutes and 180 minutes.

17. The method of claim 7, wherein the maximum pulping temperature is between 160° C. and 180° C.

18. The method of claim 8, wherein the sulfite and alkaline component are adjusted in the ratio of between about 70 to 30 and 50 to 50.

19. The method of claim 8, wherein the sulfite and alkaline component are adjusted in the ratio of 60 to 40.

20. The method of claim 9, wherein at least two additional portions of the alkaline component are added to the aqueous solution after the at least one portion.

21. The method of claim 1, wherein total weight of chemicals defined by the sulfites and alkaline component is less than or equal to about 18% weight with reference to weight of the quantity of raw materials.

22. The method of claim 1, wherein the alkaline component is selected from the group consisting of sodium hydroxide, sodium carbonate, potassium compounds, ammonium compounds and mixtures thereof.

23. A method for delignifying lignocellulosic raw materials using sulfites in the presence of an alkaline component in an aqueous solution while applying high temperatures and pressures, wherein at least one portion of the alkaline component is added to said aqueous solution at the beginning of delignification or later, characterized in that said at least one portion of the alkaline component is added after the pH value of said aqueous solution has fallen during heating, at least by an amount of pH 0.3 each time with respect to an initial pH value of the pulp.

24. The method according to claim 23, characterized in that over all percentage of chemicals defined by combined weight of sulfites and alkaline component is at least about 18 wt.% with reference to the absolutely dry weight of the raw material to be delignified.

25. The method of claim 23, wherein said at least one portion of alkaline component is added after the pH value of aqueous solution has fallen during heating by at least about pH 0.5.

26. The method of claim 23, wherein said at least one portion of alkaline component is added after the pH value of aqueous solution has fallen during heating by at least about pH 1.0.

27. The method of claim 23, wherein said at least one portion of alkaline component is added after the pH value of aqueous solution has fallen during heating by at least about pH 1.5.

28. The method of claim 24, wherein the overall percentage of chemicals is between about 22 and about 45 wt. % with reference to the absolute dry weight of the raw material to be delignified.

29. The method of claim 24, wherein the overall percentage of chemicals is between about 25 and about 35 wt. % with reference to the absolute dry weight of the raw material to be delignified.

30. The method of claim 24, wherein the overall percentage of chemicals is between about 28 and about 32 wt. % with reference to the absolute dry weight of the raw material to be delignified.

31. The method of claim 23, wherein the alkaline component is selected from the group consisting of sodium hydroxide, sodium carbonate, potassium compounds, ammonium compounds and mixtures thereof.

32. A method for delignifying lignocellulosic raw materials using sulfites in the presence of an alkaline component in an aqueous solution while applying high temperatures and pressures, wherein at least one portion of the alkaline component is added to said aqueous solution at the beginning of delignification or later, characterized in that a starting portion of the alkaline component is added before delignification starts, and wherein at least 30% of the starting portion is used up during pulping, before said at least one portion of the alkaline component is added.

33. The method according to claim 32, characterized in that between about 15 wt. % and 80 wt. % of the alkaline component is added as said starting portion and between about 85 wt. % and about 20 wt. % of the alkaline component is added as said at least one portion.

34. The method of claim 32, wherein at least 90% of said starting portion of the alkaline component is used up during pulping, before said at least one portion of the alkaline component is added.

35. The method of claim 32, wherein at least 95% of said starting portion of the alkaline component is used up during pulping, before said at least one portion of the alkaline component is added.

36. The method of claim 33, wherein between about 75 wt. % and about 30 wt. % of the alkaline component is added as the starting portion and between about 25 wt. % and about 70 wt. % of the alkaline component is added as the at least one portion.

37. The method of claim 33, wherein between about 60 wt. % and about 40 wt. % of the alkaline component is added as the starting portion and between about 40 wt. % and about 60 wt. % of the alkaline component is added as the at least one portion.

38. The method of claim 33, wherein about 50 wt. % of the alkaline component is added as the starting portion and about 50 wt. % of the alkaline component is added as the at least one portion.

39. A method for delignifying lignocellulosic raw materials using sulfites in the presence of an alkaline component in an aqueous solution while applying high temperatures and pressures, wherein at least one portion of the alkaline component is added to said aqueous solution at the beginning of delignification or later, characterized in that said at least one portion of the alkaline component is added 10 minutes after beginning of the heating process or later.

40. The method of claim 39, wherein said at least one portion of the alkaline component is added at least 30 minutes after the beginning of heating.

41. The method of claim 39, wherein said at least one portion of the alkaline component is added at least 60 minutes after the beginning of heating.

42. The method of claim 39, wherein said at least one portion of the alkaline component is added at least 90 minutes after the beginning of heating.

43. A method for delignifying lignocellulosic raw materials using sulfites in the presence of an alkaline component in an aqueous solution while applying high temperatures and pressures, wherein at least one portion of the alkaline component is added to said aqueous solution at the beginning of delignification or later, characterized in that said at least one portion is added at a temperature of at least 75° C.

44. The method of claim 43, wherein said at least one portion is added at a temperature of at least 110° C.

45. The method of claim 43, wherein said at least one portion is added at a temperature of at least 140° C.

46. The method of claim 43, wherein said at least one portion is added at a temperature of at least 175° C.

47. A method for delignifying lignocellulosic raw materials using sulfites in the presence of an alkaline component in an aqueous solution while applying high temperatures and pressures, wherein at least one portion of the alkaline component is added to said aqueous solution at the beginning of delignification or later, characterized in that said at least one portion of the alkaline component is added at the end of the heating process when the maximum pulping temperature has been reached.

* * * * *